United States Patent [19]

Bertilsson et al.

[11] 3,938,740

[45] Feb. 17, 1976

[54] NOZZLE FOR ELECTROSTATIC SPRAY GUN

[75] Inventors: Alf Georg Bertilsson, Falkoping; Sten Gunnar Hugo Svensson; Claes Erik Söderman, both of Skara, all of Sweden

[73] Assignee: Atlas Copco Aktiebolag, Nacka, Sweden

[22] Filed: Apr. 17, 1974

[21] Appl. No.: 461,589

[30] Foreign Application Priority Data

Oct. 4, 1973 Sweden ..... 7313505

[52] U.S. Cl. ..... 239/15; 239/3

[51] Int. Cl.[2] ..... B05B 5/02; B05B 7/04

[58] Field of Search ..... 239/3, 15; 118/626; 117/93.4 R

[56] References Cited

UNITED STATES PATENTS

| | | | |
|---|---|---|---|
| 3,072,341 | 1/1963 | Point et al. | 239/15 |
| 3,128,045 | 4/1964 | Gauthier | 239/15 |
| 3,169,883 | 2/1965 | Juvinall | 239/15 X |
| 3,268,171 | 8/1966 | Walberg | 239/3 X |
| 3,290,169 | 12/1969 | Sedlacsik | 239/15 X |
| 3,292,860 | 12/1966 | Williams et al. | 239/3 X |
| 3,317,138 | 5/1967 | Fraser | 239/15 |
| 3,348,186 | 10/1967 | Rosen | 239/15 UX |
| 3,764,068 | 10/1973 | Lacchia | 239/3 |
| 3,826,425 | 7/1974 | Scharfenberger et al. | 239/15 |

*Primary Examiner*—Robert S. Ward, Jr.
*Attorney, Agent, or Firm*—Flynn & Frishauf

[57] ABSTRACT

An electrostatic spray gun for liquid paint has a nozzle that comprises an inner body formed of a sintered material that consists of an electrically non-conductive matrix, e.g. polytetrafluoroethylene, with conductive particles, e.g. bronze powder, dispersed in the matrix, and an outer body of electrically insulating plastic material. The rear end of the inner body is connected to high voltage, and it has an annular front surface around a paint discharge orifice. This surface shows a lot of such bronze particles that form point electrodes for producing air ions. Two additional needle electrodes are clamped between the two bodies. The paint is dispersed by air jets and the air ions attach to the paint particles.

31 Claims, 4 Drawing Figures

NOZZLE FOR ELECTROSTATIC SPRAY GUN

This invention relates to electrostatic spray guns, and more particularly to an improved nozzle for such spray guns.

BACKGROUND OF THE INVENTION

It has been found that the best way to impart an electrostatic charge to paint is to produce air ions that are intimately mixed with the paint particles that can be either liquid or solid. To this end, needle electrodes connected to a high voltage source have been used in prior art electrostatic spray guns. The best result seems to have been achieved when a sole properly located needle electrode has been used. Alternatively, the paint nozzle itself has been utilized as an electrode in some prior art spray guns. Then, the nozzle has been made of metal and connected to high voltage. This is a more robust construction but it is not as efficient as the ones having needle electrodes. In one prior art spray gun for liquid paint, a sole needle electrode extends axially through the discharge orifice of the nozzle. Although its charging properties are good, the electrode has disadvantages. One major disadvantage is that the paint pattern is seriously biased when the needle is not quite coaxial with the discharge orifice.

It is an object of the invention to provide electrostatic spray guns which efficiently charge the liquid or solid paint particles and which withstand negligent handling without their charging efficiency becoming decreased. Another object is to provide a simple and reliable connection of high voltage to the charging electrodes of an electrostatic spray gun. An ancillary object is to provide an electrostatic spray gun which in use is not apt to produce sparking.

SUMMARY OF THE INVENTION

In accordance with the present invention, a nozzle for an electrostatic spray gun comprises a non-conductive first body and a second body at least partly covered by the first body, the second body consisting essentially of a non-conductive matrix having electrically conductive particles dispersed therein. The second body is coupled to a source of high voltage. The second body defines a discharge orifice for the paint, and an annular surface of the second body around the discharge orifice includes a plurality of exposed conductive particle surfaces forming a plurality of electrodes for producing air ions. A plurality of the exposed conductive particle surfaces comprise a substantial portion of the maximum cross-section of the respective particle, the exposed particle surfaces being substantially coplanar with the immediately adjacent surface of the non-conductive matrix material.

BRIEF DESCRIPTION OF THE DRAWINGS

The invention is further described with reference to the accompanying drawings in which an electrostatic spray gun intended for liquid paint is shown by way of example. The invention can be applied also to an airless spray gun and to a powder spray gun although such embodiments are not illustrated.

DESCRIPTION OF THE PREFERRED EMBODIMENT

Figure 1:
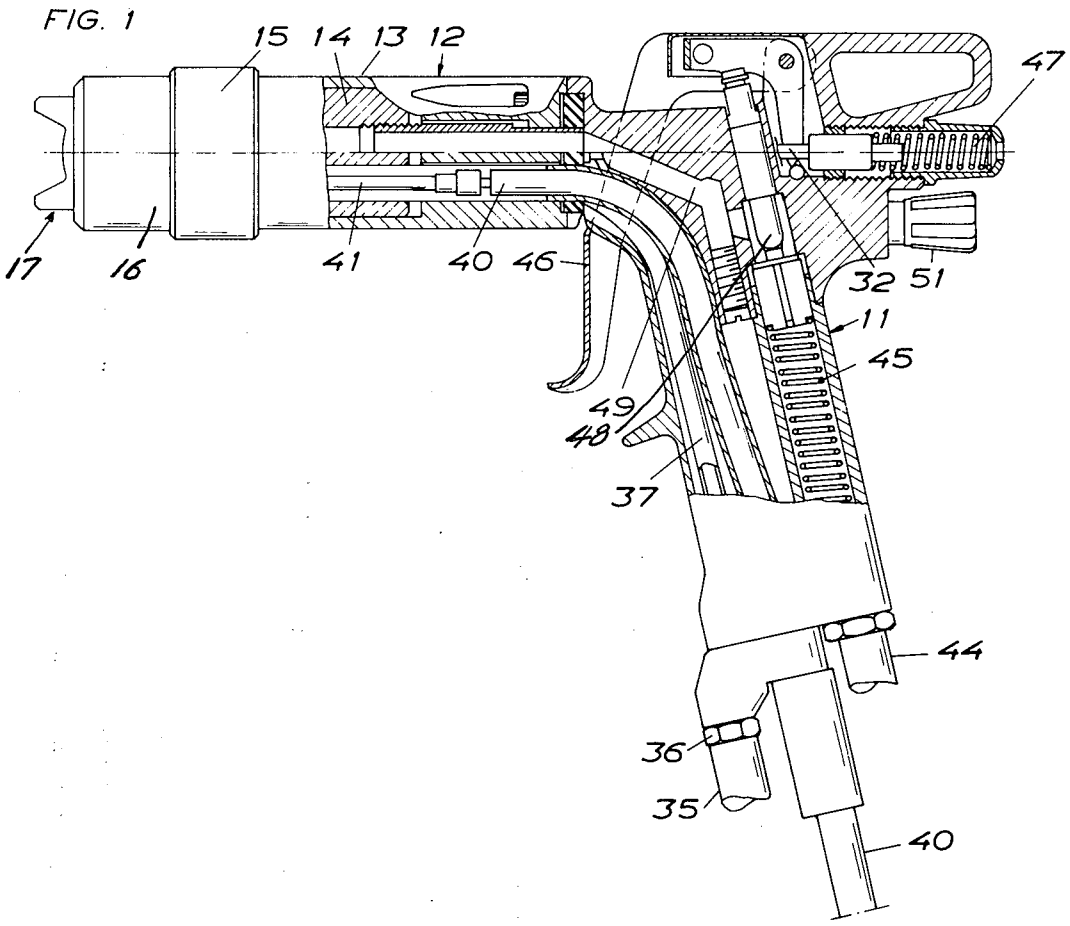
FIG. 1 is a side view, partly in section, of the spray gun.

The spray gun shown in the Figures is intended for liquid paint that is dispersed by air jets. It comprises generally an electrically conductive rear portion 11, that forms a grounded handle, and a barrel-formed portion 12. The barrel-formed portion comprises a cylindrical housing 13 that is affixed to the handle 11 by means of screws. A cylindrical body 14 is held in the housing 13 by means of a nut 15 and another nut 16 clamps an air nozzle 17 to the cylindrical body 14. The cylindrical housing 13, the nuts 15, 16 and the air nozzle 17 are made of an electrically insulating plastic material.

Figure 3:
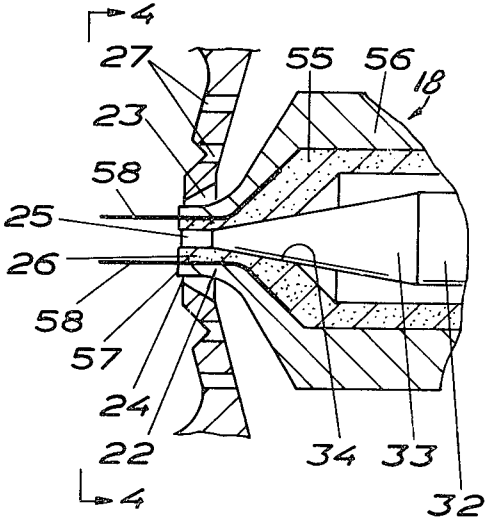
FIG. 3 shows a part of FIG. 2 at a still larger scale.
Figure 4:
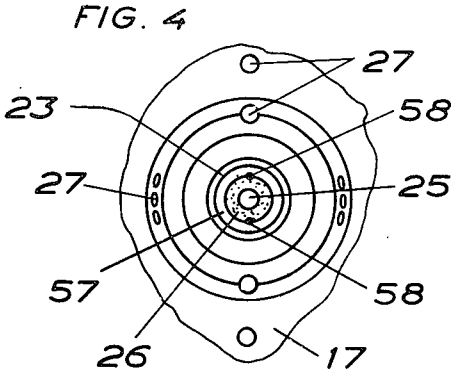
FIG. 4 is a front view seen as indicated by the arrows 4—4 in FIG. 2.
Figure 2:
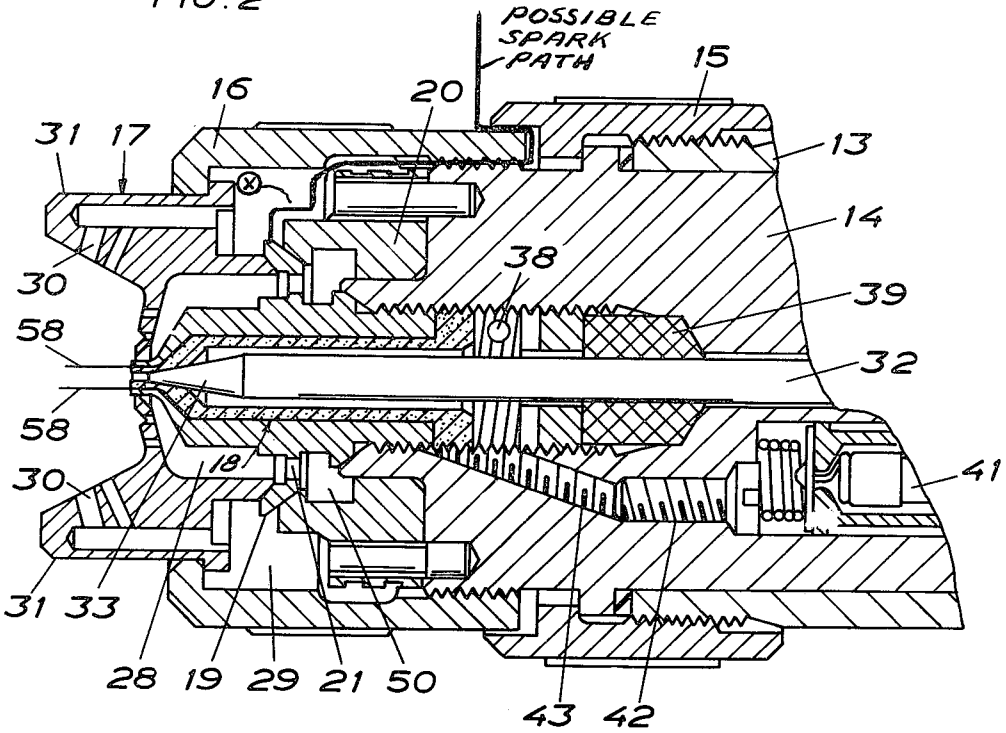
FIG. 2 is a longitudinal section, at a larger scale, through the forward portion of the spray gun shown in FIG. 1.

Referring to FIG. 3, a paint nozzle 18 comprises an inner body 55 and an outer body 56 that are press-fitted together to form a unit. The outer body 56 consists of an electrically insulating plastic material and the inner body 55 consists of an electrically non-conductive matrix, e.g. polytetrafluoroethylene (hereinafter referred to as PTFE), with electrically conductive particles, e.g. bronze particles or graphite particles, uniformly dispersed therein. Two metal needles 58 are clamped between the two bodies 55, 56 and they extend rearwardly up along the conical surface between the two bodies so that they are held firmly and are in good contact with the inner body 55. The inner body 55 is machined from a sintered piece of material. As seen in FIG. 2, a thread has been cut in the rear end of the paint nozzle 18 and the paint nozzle is screwed into the cylindrical body 14.

The outer body 56 of the paint nozzle has a flange 19 (FIG. 2) that is clamped between a support ring 20 and the air nozzle 17. A plurality of axial holes 21 extend through the flange 19. The paint nozzle 18 has a forward extension 22 that extends through a central hole 23 in the air nozzle with an annular gap 24 thereto. There is a paint discharge orifice 25 in the extension 22 so that the inner body 55 forms an annular forward directed surface 26 that defines the discharge orifice 25. The outer body 56 forms an annular surface 57 flush with the surface 26.

The gap 24 and a plurality of holes 27 (FIG. 3) in the air nozzle are supplied with air from an annular chamber 28 (FIG. 2). Another annular chamber 29 supplies air to obliquely inward-directed passages 30 in two horns 31 on the air nozzle 17. An axial and axially slidable rod 32 of electrically insulating plastic material has a coned tip 33 that forms a paint valve with a coned seat 34 formed inside the inner body 55 of the paint nozzle and close to the discharge orifice 25. The interior of the paint nozzle is supplied with paint through an external hose 35, a hose fitting 36, a hose 37 inside the handle 11 and a passage 38 through the cylindrical body 14. The rod 32 extends through a packing 39 that prevents leakage.

Since the inner body 55 of the paint nozzle 18 is machined from a sintered body that consists of an electrically non-conductive matrix with electrically conductive particles dispersed therein and since the annular surface 26 is machined after the sintering, this surface 26 will show a large number of conductive particles which form electrode points. The rear end of the inner body 55 of the paint nozzle 18 is connected to an outer source of high voltage through a shielded cable 40, a safety impedance 41 and two screws 42, 43. It is not necessary that all the conductive particles in the matrix be in direct contact with each other.

Air is supplied through a hose 44 (FIG. 1) to an inlet chamber 45 in the handle 11. When a trigger 46 is pulled, it pulls the rod valve 32 backwards against the action of a spring 47 and it also opens an air valve 48 that admits air to a passage 49 that leads to an annular chamber 50 — that, as shown in FIG. 2, communicates with the annular chamber 28 by means of the holes 21 — and to another non-illustrated passage that leads to the annular chamber 29. The air through the circular gap 24 (FIG. 3) and through the holes 27 disperses the liquid into fine particles and the electrode points in the annular surface 26 around the discharge orifice 25 produce air ions that attach to the paint particles. The air through the horns 31 flattens the paint spray. The air to the annular chamber 29 and thereby to the horns 31 can be shut off by a manually controlled valve 51 when a round pattern instead of a flat pattern is desired.

The needles 58 are likely to be bent or to be broken if the spray gun is negligently handled by the operator, but it is to be noted that the charging efficiency of the spray gun is not at all or at least very little affected by the position of the needles. Likewise, the charging efficiency is not at all or very little affected when one or both of the needles 58 are lost.

In prior art guns having needle electrodes, the charging efficiency and/or spray pattern have been very seriously affected when a needle has been bent only a little.

Two needles are shown as being preferred, but a single needle or a few more than two needles can also be utilized. It is convenient to have two or three needles since it is not very likely that two needles will be broken at the same time.

The nozzle can also be utilized without being equipped with the needles 58 although the needles seem to reduce the risk of sparking when the nozzle is moved too close to a grounded object since corona discharges rather than sparks are formed at their tips.

It is a great advantage that there is an insulating cover 56 on the sintered body 55 when no needles 58 are used so that the electrode forming surface 26 can be made thin, e.g. a quarter of a millimeter, which reduces the risk of sparking. This risk is further reduced by the fact that the atomizing air through the annular gap 24 does not contact the surface of the sintered body 55 and the outer edge of the electrode forming surface 26.

What we claim is:

1. Electrostatic spray gun comprising a paint nozzle with a paint discharge orifice, means to convey paint to said orifice, and means coupling high voltage to said nozzle, said nozzle comprising:

a non-conductive first body and a second body at least partly covered by said first body, said second body consisting essentially of a non-conductive matrix and a large number of electrically conductive particles dispersed therein, said discharge orifice being an orifice in said second body;

said high voltage being coupled to said second body of said nozzle; and said second body having an annular surface around the paint discharge orifice which includes a plurality of exposed particle surfaces forming a plurality of electrodes for producing air ions, a plurality of said exposed particle surfaces comprising a substantial portion of the maximum cross-section of the respective particle, the exposed particle surfaces being substantially coplanar with the immediately adjacent surface of said non-conductive matrix.

2. Spray gun according to claim 1 comprising valve means inside said paint nozzle.

3. Spray gun according to claim 1 comprising a valve means disposed in said second body close behind said discharge orifice.

4. Spray gun according to claim 3, wherein said valve means comprises a valve seat formed in said second body and an axially movable rod that is coaxial with said paint discharge orifice and cooperates with said valve seat.

5. Spray gun according to claim 4, wherein said valve seat is conical and said rod has a conical portion cooperating with said valve seat.

6. Spray gun according to claim 4, wherein said rod is electrically non-conductive.

7. Spray gun according to claim 1 including at least one forward-directed needle electrode affixed to said nozzle and extending forwardly of said annular surface of said second body.

8. Spray gun according to claim 7 wherein said at least one forward directed needle electrode is clamped between said first and second bodies.

9. Spray gun according to claim 1 wherein substantially all of said exposed particle surfaces are spaced from each other.

10. Spray gun according to claim 1 wherein said non-conductive matrix is polytetrafluoroethylene, and wherein said electrically conductive particles are bronze powder particles.

11. Spray gun according to claim 1 wherein said paint is liquid paint.

12. Spray gun according to claim 1 wherein said paint comprises a plurality of solid particles.

13. Electrostatic spray gun comprising:

an air nozzle of electrically insulating material and having an orifice therein;

a paint nozzle extending through said orifice with a clearance thereto to form an air passage, said paint nozzle comprising a central body having a paint passage therein and forming a paint discharge orifice and an outer body of electrically insulating material closely covering at least part of said central body;

means to convey atomizing air to said air passage;

valve means in said paint passage in said central body to selectively open and close said paint passage;

means to convey paint to said paint passage;

said central body consisting essentially of a non-conductive matrix and a large number of electrically conductive particles dispersed therein, said central body having an annular surface around the paint discharge orifice which includes a plurality of exposed particle surfaces forming a plurality of electrodes for producing air ions, a plurality of said exposed particle surfaces comprising a substantial portion of the maximum cross-section of the respective particle, the exposed particle surfaces being substantially coplanar with the immediately adjacent surface of said non-conductive matrix; and means coupling high voltage to said central body.

14. Spray gun according to claim 13, wherein said outer body has a front surface substantially flush with said surface having electrodes therein.

15. Spray gun according to claim 13 wherein said central body is press fit within said outer body.

16. Spray gun according to claim 15, wherein said paint nozzle includes at least one forward-directed needle electrode clamped between said press fit portions of said central body and said outer body and extending forwardly of said annular surface of said central body.

17. Spray gun according to claim 13, wherein said valve means comprises a valve seat formed in said central body and an axially movable rod cooperating with said valve seat.

18. Spray gun according to claim 17, wherein said rod is coaxial with said paint discharge orifice.

19. Spray gun according to claim 18, wherein said valve seat is conical and is disposed close behind said paint discharge orifice, said rod having a conical tip portion cooperating with said valve seat.

20. Spray gun according to claim 17, wherein said rod is electrically non-conductive.

21. Spray gun according to claim 13 wherein substantially all of said exposed particle surfaces are spaced from each other.

22. Spray gun according to claim 13 wherein said non-conductive matrix is polytetrafluoroethylene, and wherein said electrically conductive particles are bronze powder particles.

23. Spray gun according to claim 13 wherein said paint is liquid paint.

24. Spray gun according to claim 13 wherein said paint comprises a plurality of solid particles.

25. Spray gun according to claim 1, wherein said second body is a sintered body and wherein said annular surface is a machined surface which is machined after the sintering in order to obtain said electrodes.

26. Spray gun according to claim 25 wherein said non-conductive matrix is polytetrafluoroethylene, and wherein said electrically conductive particles are bronze powder particles.

27. Spray gun according to claim 13, wherein said central body is a sintered body and wherein said annular surface is a machined surface which is machined after the sintering in order to obtain said electrodes.

28. Spray gun according to claim 27, wherein said non-conductive matrix is polytetrafluoroethylene, and wherein said electrically conductive particles are bronze powder particles.

29. A nozzle for use in an electrostatic spray gun, comprising a non-conductive first body and a second body at least partly covered by said first body, said second body consisting essentially of a non-conductive matrix and a large number of electrically conducting particles dispersed therein, said second body having a paint discharge orifice therein, said second body further having an annular surface around said paint discharge orifice which includes a plurality of exposed particle surfaces forming a plurality of electrodes for producing air ions, a plurality of said exposed particle surfaces comprising a substantial portion of the maximum cross-section of the respective particle, the exposed particle surfaces being substantially coplanar with the immediately adjacent surface of said non-conductive matrix.

30. Nozzle according to claim 29, wherein said second body is a sintered body and wherein said annular surface is a machined surface which is machnned after the sintering in order to obtain said electrodes.

31. Spray gun according to claim 30 wherein said non-conductive matrix is polytetrafluoroethylene, and wherein said electrically conductive particles are bronze powder particles.

* * * * *